United States Patent [19]

Beam, Jr. et al.

[11] 4,208,010

[45] Jun. 17, 1980

[54] VENTILATOR ASSEMBLY

[76] Inventors: Dennis A. Beam, Jr., Westfield Rd.; Paul M. Sarazen, Jr., 214 Fairway Dr., both of Shelby, N.C. 28150

[21] Appl. No.: 924,501

[22] Filed: Jul. 14, 1978

[51] Int. Cl.[2] ..... F24F 7/00; F24F 13/14

[52] U.S. Cl. ..... 236/49; 98/114

[58] Field of Search ..... 236/49; 98/114; 264/249; 248/224.3, 224.4; 312/111

[56] References Cited

U.S. PATENT DOCUMENTS

| | | | |
|---|---|---|---|
| 2,814,977 | 12/1957 | Noll | 236/49 X |
| 3,298,298 | 1/1967 | Iwata | 236/49 X |
| 3,436,016 | 4/1969 | Edwards | 236/49 |
| 3,499,808 | 3/1970 | Obeda | 264/249 |
| 3,528,606 | 9/1970 | Witten | 236/49 X |
| 4,006,672 | 2/1977 | Matsuyoshi et al. | 98/114 X |
| 4,056,067 | 11/1977 | Steger | 312/111 X |

*Primary Examiner*—Albert J. Makay
*Assistant Examiner*—William E. Tapolcai, Jr.
*Attorney, Agent, or Firm*—Luke J. Wilburn, Jr.; Wellington M. Manning, Jr.

[57] ABSTRACT

A foundation ventilator assembly that includes a housing in which are received at least one, and preferably a plurality of pivotal louver type elements that may be moved from an open to a closed position. In a preferred arrangement the plurality of louvers are interconnected to move as a unit and the unit is controlled by a temperature responsive bi-metalic spring to open or close the louvers depending upon the ambient temperature. A first grill is provided and is permanently secured to a side of the ventilator that will be presented as the outside during use with the grill having a screen thereacross. A second grill is provided and is removably securable to the rear side of the ventilator housing with the second screen having a grid across the ventilator opening through the housing with a screen secured thereto. The second grill is preferably manufactured of unitary construction of a thermally deformable plastic material and has a plurality of projections extending outwardly therefrom over which a screen is placed. After placement of the screen the projections are thermally deformed to unite the screen to the grill. The second, removable grill is provided with flanges along two sides to be received within the housing and afford further rigidity to the ventilator assembly. The ventilator housing and/or grill are provided with mating connections for frictional engagement therebetween.

6 Claims, 5 Drawing Figures

VENTILATOR ASSEMBLY

BACKGROUND OF THE INVENTION

Ventilators have been utilized in foundations of building structures with louvers therein which may be opened or closed depending the ambient temperature. The basic ventilator structure includes a plurality of louvers and a hand operated element for closing the louvers during cold weather and opening same during warm weather. This foundation ventilator has an outer grill that is secured thereto to preclude ingress of insects or the like through the ventilator structure.

Substantial development effort has been directed to foundation type ventilators so as to improve same. In this regard, a number of patents have issued to various individuals as listed below directed to improved ventilator features:

U.S. Pat. No. 2,802,410—Robinson
U.S. Pat. No. 3,202,082—Viehmann
U.S. Pat. No. 3,220,079—Aggson
U.S. Pat. No. 3,741,102—Kaiser
U.S. Pat. No. 3,815,638—Martin
U.S. Pat. No. 3,833,989—McCabe
U.S. Pat. No. 3,864,889—Hobbs Likewise, development as proceeded along the lines of automatic opening and closing of the louvers of the ventilator assemblies as represented by the following listed patents:

U.S. Pat. No. 302,215—Tucker
U.S. Pat. No. 1,335,929—Allen
U.S. Pat. No. 2,117,529—Wile et al
U.S. Pat. No. 2,187,767—Akers
U.S. Pat. No. 2,216,873—Browne
U.S. Pat. No. 2,241,108—Akers
U.S. Pat. No. 2,551,965—Petersen
U.S. Pat. No. 2,814,977—Noll
U.S. Pat. No. 3,195,441—Hedrick
U.S. Pat. No. 3,027,090—Zerhan
U.S. Pat. No. 3,068,776—Day
U.S. Pat. No. 3,368,756—Edwards
U.S. Pat. No. 3,436,016—Edwards
U.S. Pat. No. 3,528,606—Witten None of the above cited prior art discloses or suggests the use of a ventilator assembly with the removable rear grill as defined by applicants herein. It is not believed that the prior art teaches or suggests applicants' claimed invention.

Removability of the rear grill is of substantial import to permit cleaning the ventilator assembly if and when desired, and though permanent installations of screens as shown in Witten, U.S. Pat. No. 3,528,606 for example have been used, they are not believed to be anticipatory or suggestive of applicants' concept.

SUMMARY OF THE INVENTION

It is an object of the present invention to provide an improved foundation ventilator assembly.

Another object of the present invention is to provide an improved ventilator assembly which utilizes louvers that are automatically operated responsive to ambient temperature.

Still another object of the present invention is to provide an improved ventilator assembly having protective means on opposite sides thereof, the rear means of which is removably securable to the ventilator housing to permit ready access to the louvers for cleaning and maintenance.

Yet another object of the present invention is to provide an improved grill for a ventilator assembly.

Generally speaking the present invention is directed to an improved ventilator assembly comprising a housing, said housing defining a ventilating opening therewith; at least one element rotatably received within said housing and being movable from a closed position in which the ventilating opening is substantially closed to an open position; a first grill secured to said housing across said ventilating opening; and a second grill removably securable to said housing along a side opposite said first grill.

More specifically, the improved ventilator assembly of the present invention includes a housing that is generally a quadrilateral and more specifically rectangular in cross section and defines a ventilating opening therewithin. A plurality of louvers are rotatably mounted within the housing and are interconnected to move as a unit from an open to a closed position or vice versa to close off the ventilating opening or to open same. The ventilators are most preferably associated with a temperature responsive bi-metalic spring means to automatically open and close same depending upon the ambient temperature. An outside of the ventilator during normal use is provided with an integral grill-screen structure to protect the louvers and to prevent ingress of insects and varmints through the ventilator assembly. The reverse or inside of the ventilator assembly, according to the present invention is provided with a second grill-screen sub assembly unit that is removably securable to the housing to enclose the rear side of the ventilator assembly. Such closure prevents damage to the louvers from the inside and likewise prevents an accumulation of insects in the assembly which could adversely alter the automatic operation thereof. In order to permit cleaning of the ventilator assembly at desired intervals, however, the second grill-screen sub assembly is removably securable to the housing.

A further aspect of the present invention is directed to a grill-screen assembly per se wherein the sub assembly is provided with a framework that is dimensioned according to dimensions of a ventilator housing to which it is to be removably secured. The grill-screen assembly is provided with a grid work, skeletal in nature, across an opening defined by the framework and in a preferred arrangement the grid is of unitary construction with the frame, preferably having been molded from a thermally deformable synthetic polymeric material. The grill sub assembly is provided with a pair of flanges depending from the framework and extending outwardly therefrom in a direction such that when secured to the ventilator housing, the flanges will reside within the framework of the housing to add further rigidity to the ventilator assembly. Likewise since the removable securement is desired for the grill sub assembly, the framework of the sub assembly is provided with detents or projections that mate with detents or projections on the ventilator housing to provide a frictional engagement therewith. The grill sub assembly is further provided with a series of thermally deformable projections that extend outwardly from the framework and/or grid structure with the projections being of a particular size such that a screen may pass thereover. Once the screen has been placed over the projections, the projections may be thermally defomed to melt and embed the screen thereat and thereby permanently secure the screen to the grid.

DISCRIPTION OF THE PREFERRED EMBODIMENTS

Figure 1:
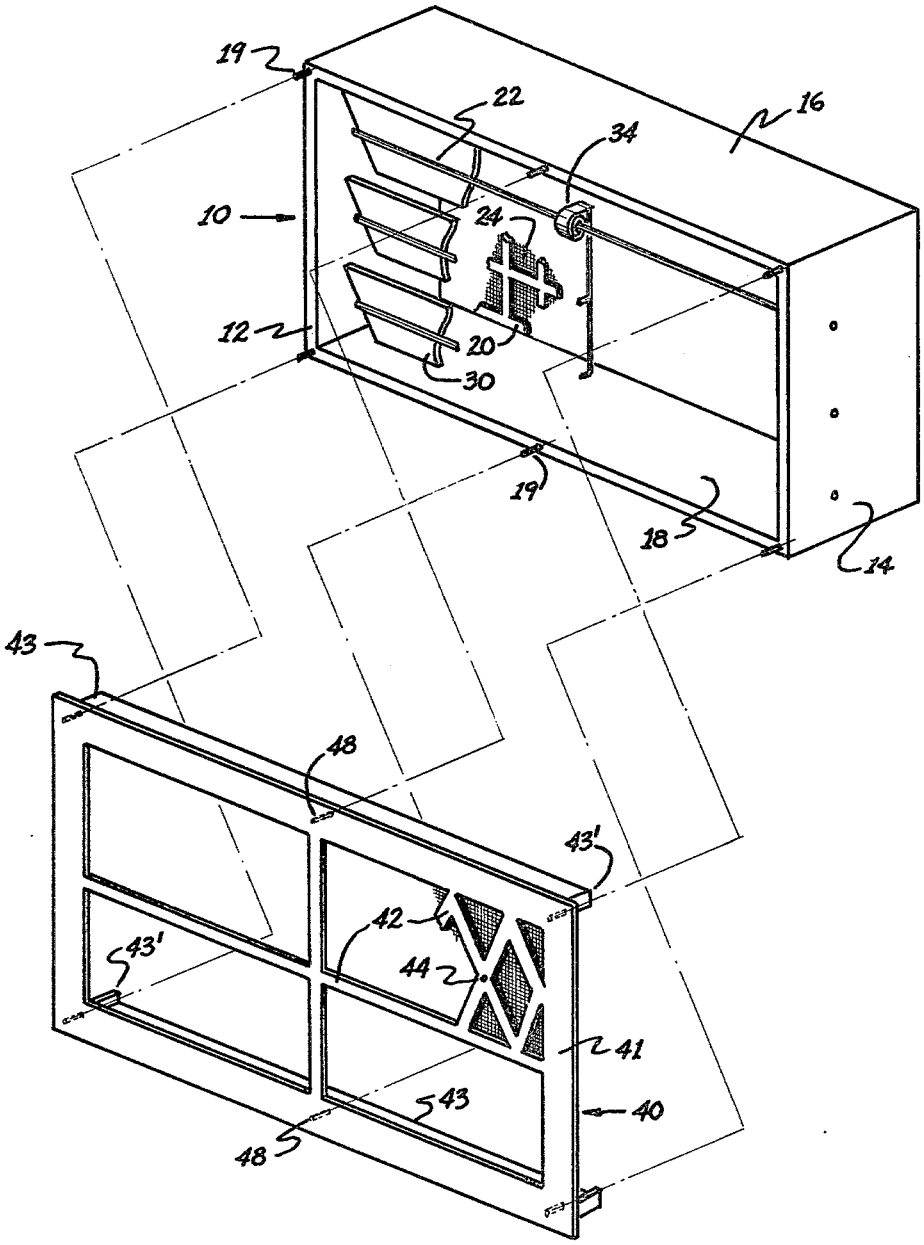
FIG. 1 is a partially exploded view of a ventilator assembly according to the present invention.

Making reference to the Figures, preferred embodiments of the present invention will now be described in detail. In FIG. 1 there is shown an exploded view of a ventilator assembly according to the present invention in which a ventilator housing generally indicated as 10 is provided. Housing 10 is formed of vertical side walls 12 and 14 and horizontal side walls 16 and 18 all of which cooperate to define a ventilating opening within housing 10. A first grill-screen arrangement generally indicated as 20 is secured to an end of housing 10 that is normally disposed at exterior of the building structure to which it is mounted. Grill 20 is normally provided by a grid work 22 of a particular configuration in conjunction with a screen 24 associated therewith to preclude the ingress of insects and varmits to the inside of the structure in which the ventilator assembly is mounted. Though not shown in FIG. 1, a grill 20 would obviously extend across the entire ventilating opening within housing 10.

Likewise secured within housing 10 is at least one rotatably supported element that is movable from an open to a closed position to effectively close or open the ventillating opening through housing 10. As shown in FIG. 1 a plurality of louvers 30 are provided which louvers are preferably interrelated such as for example as is described in the Edwards U.S. Pat. No. 3,436,016 where the individual louvers are connected by a rod 32 with a thermally responsive bimetalic coiled spring 34 being provided to open and close the louvers automatically depending upon ambient temperature.

Figure 2:
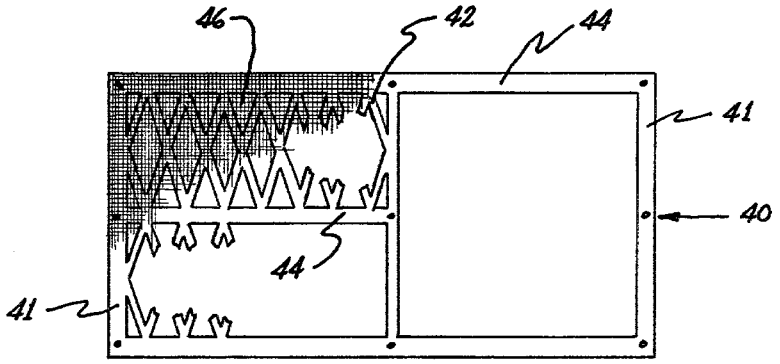
FIG. 2 is an elevational view of a grill sub assembly according to the teachings of the present invention.
Figure 3:
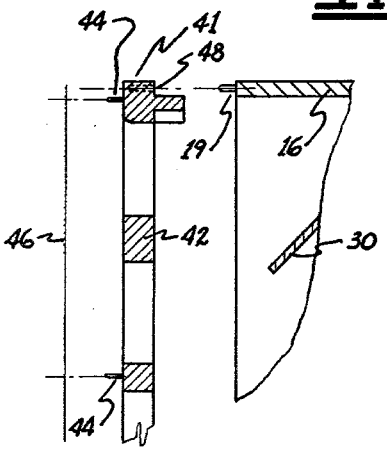
FIG. 3 is a partial exploded cross sectional elevational view of a ventilator assembly illustrating features of the present invention.
Figure 4:
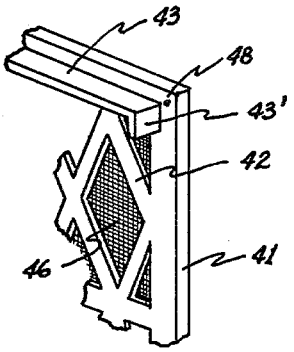
FIG. 4 is a partial rear view of a grill sub assembly according to teachings of the present invention.
Figure 5:
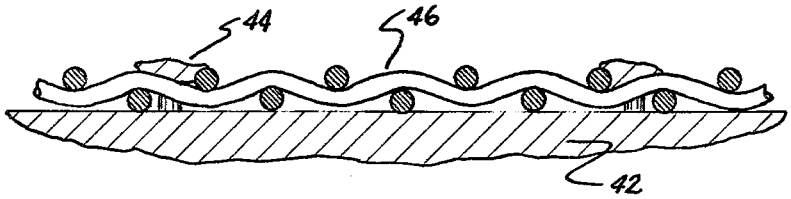
FIG. 5 is a partial cross sectional view of a grill sub assembly according to teachings of the present invention illustrating a further embodiment of same.

A second grill sub assembly generally indicated as 40 is provided for removable securement to a rear side of the ventilator assembly Grill 40 affords further rigidification of the assembly and protection against ingress of insects and varmints from the rear of the assembly which could adversely effect the automatic operation of the louvers. Making particular reference to FIGS. 2–5 the removable grill sub assembly 40 includes an outer framework 41 which corresponds generally to the external dimensions of the ventilator housing and provides a ventilation opening therewithin. A grid structure 42 is provided internally of outer frame 41 and extends across the opening defined thereby. Preferably as shown in FIG. 2 the grid structure 42 is skeletal in nature so as to avoid impeding airflow through the ventilating opening of housing 10. As particularly shown in FIGS. 1 and 4 second grill sub assembly 40 is provided with flanges 43 along top and bottom portions of frame 41 and extending outwardly therefrom. Note that no flange 43 is provided along the sides of frame 41 of grill 40 that could interfere with the operation of louvers 30. Instead, the flange 43 merely have short vertical section 43' sufficient only to define a corner at the ends of flanges 43. When secured to the housing 10, flanges 43 and 43' extend within the framework of sides 12, 14, 16 and 18 to further rigidify the overall ventilator assembly. Grill sub assembly 40 is further provided with a plurality of thermally deformable projections 44 that may extend from either side of frame 41 or grid 42. The particular placement of same, however, as will be fully discussed hereinafter, should be made not to interfere with other projections from grill sub assembly. As shown in FIGS. 2 and 5, projections 44 extend outwardly away from housing 10 and receive a screen 46 thereover. Projections 44 are of such a size to pass through the interstices of the screen after which as particularly shown in FIG. 5, projections 44 may be contacted with a heated element to deform and partially encapsulate screen 46. Screen 46 is thereby secured to grill sub assembly frame 41 and grid 42.

In securing grill sub assembly 42 to the ventilator housing 10 as mentioned earlier, flanges 43 and 43' extend within the side walls 12, 14, 16, and 18 of housing 10 and may provide some frictional engagement therewith. Housing 10 and grill sub assembly 40 are preferably, however, provided with mating elements to further provide frictional engagement therebetween. As illustrated in the Figures, small projections 19 are provided around the periphery of housing 10 while grill sub assembly 40 is provided with detents 48 to mate with projections 19 and provide the frictional engagement. Obviously the projections 19 may be provided on the grill sub assembly 40 and the detents on the housing, or both the housing and the grill sub assembly may be provided with each. In the event grill sub assembly 40 is provided with projections 19 to mate with detents 48 on housing 10, it becomes necessary to carefully select the areas for location of the thermally deformable projections 44, particularly where the entire grill sub assembly 40 except for the screen is molded of a thermally deformable synthetic polymeric material. Hence, the thermally deformable projections 44 for securing the screen to the grid may be located on an opposite side to that from which projections 19 are located or in the event that they are on the same side, the thermally deformable projections 44 should be so located to be easily contacted by heated element for thermal deformation without the possibility or danger of likewise thermally deforming projections 19.

From the foregoing detailed description of a preferred embodiment of the invention, it can be seen that the improved ventilator construction of the present invention may be employed in existing openings of masonry walls of new constructions, as well as replacements for ventilators in existing wall constructions, and may be installed therein in rapid easy and simplified manner.

That which is claimed is:

1. An improved ventilator assembly comprising:

(a) a housing, said housing defining a ventilating opening therewithin;

(b) at least one shutter element rotatably received within said housing and being moveable from a closed position in which the ventilating opening is substantially closed to an open position;

(c) temperature responsive means associated with said at least one shutter element to automatically adjust said at least one shutter element responsive to ambient temperature;

(d) a first grill secured to said housing at one end, across said ventilating opening, said grill comprising a gridwork having a screen associated therewith; and (e) a second grill associated with said housing on an end of same opposite said first grill, whereby said ventilator assembly is generally protected from insects from both sides, said second grill comprising a frame having a gridwork thereacross and a screen secured to said grid, said frame having projecting means extending across the top and bottom of the frame with short vertical sections at each end to define flange corners, and said flanges being mateably receivable within said housing whereby said second grill is removably secured to said assembly to provide access to the inside of said housing.

2. An improved ventilator assembly as defined in claim 1 further including fingerlike projections extending outwardly from the periphery of said housing, and a corresponding plurality of detents extending into the periphery of said second grill frame for matingly receiving respective of said fingerlike projections to further facilitate removable securement of said second grill to said assembly.

3. An improved ventilator assembly as defined in claim 1 further including fingerlike projections extending outwardly from the periphery of said second grill frame, and a corresponding plurality of detents extending into the periphery of said housing for matingly receiving respective of said fingerlike projections to further facilitate removable securement of said second grill to said assembly.

4. An improved ventilator assembly comprising:

(a) a housing, said housing having horizontal and vertical side walls defining a ventilating opening therewithin;

(b) at least one louver mounted within said housing for movement between a closed position in which the ventilating opening is substantially closed to an open position;

(c) temperature responsive means associated with said at least one louver to automatically open or close same dependent upon ambient temperature;

(d) a first grill secured to said housing across said ventilating opening, said grill comprising a gridwork having a screen associated therewith; and (e) a second grill associated with said housing at an end opposite said first grill, said second grill comprising an outer framework corresponding generally to the external dimensions of the housing and defining an opening therewithin generally coincident with said ventilating opening, a skeletal gridwork secured to said framework and extending across said opening, said gridwork having a plurality of thermally deformable projections thereon and a screen secured to said gridwork and extending across said opening, said screen being secured to said gridwork by said projections passing through said screen and being thermally deformed, said framework having projecting flanges extending along the top and bottom portions of the framework along the periphery thereof with short vertical flange sections at each end defining flange corners, and said flanges being frictionally receivable within said housing at locations where movement of said at least one louver will not be affected thereby, whereby said second grill is removable from said housing to provide access to the interior thereof.

5. An improved ventilator assembly as defined in claim 4 wherein said housing includes a plurality of fingerlike projections extending outwardly from the periphery thereof, and said framework includes a corresponding plurality of detents in the periphery thereof for matingly receiving corresponding ones of said fingerlike projections to further facilitate frictional securement of said second grill to said housing.

6. An improved ventilator assembly as defined in claim 4 wherein said framework includes a plurality of fingerlike projections extending outwardly from the periphery thereof, and said housing includes a corresponding plurality of detents in the periphery thereof for matingly receiving corresponding ones of said fingerlike projections to further facilitate removable securement of said second grill to said housing.

* * * * *

UNITED STATES PATENT AND TRADEMARK OFFICE

CERTIFICATE OF CORRECTION

PATENT NO. : 4,208,010

DATED : June 17, 1980

INVENTOR(S) : Dennis A. Beam, Jr., Paul M. Sarazen, Jr.

It is certified that error appears in the above-identified patent and that said Letters Patent are hereby corrected as shown below:

In the Abstract, line 7, "bi-metalic" should read--bimetallic--.

Column 1, line 7, after "depending" insert--upon--.

Column 2, line 24, "bi-metalic" should read--bimetallic--.

Column 2, line 68, "defomed" should read--deformed--.

Column 3, line 34, "varmits" should read--varmints--.

Column 3, line 42, "ventillating" should read--ventilating--.

Column 3, line 47, "bimetalic" should read--bimetallic--.

Column 3, line 52, after "assembly" insert a period.

Signed and Sealed this

*Twenty-first* Day of *October 1980*

[SEAL]

*Attest:*

SIDNEY A. DIAMOND

*Attesting Officer*

*Commissioner of Patents and Trademarks*